US007901862B2

(12) United States Patent
Itou et al.

(10) Patent No.: US 7,901,862 B2
(45) Date of Patent: Mar. 8, 2011

(54) DEVELOPING AGENT AND METHOD FOR MANUFACTURING THE SAME

(75) Inventors: Tsuyoshi Itou, Shizuoka (JP); Takayasu Aoki, Shizuoka (JP); Takashi Urabe, Shizuoka (JP); Motonari Udo, Shizuoka (JP); Yasuhito Noda, Shizuoka (JP); Satoshi Araki, Shizuoka (JP); Masahiro Ikuta, Shizuoka (JP); Takafumi Hara, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 134 days.

(21) Appl. No.: 12/244,251

(22) Filed: Oct. 2, 2008

(65) Prior Publication Data

US 2009/0136864 A1 May 28, 2009

Related U.S. Application Data

(60) Provisional application No. 60/990,395, filed on Nov. 27, 2007.

(51) Int. Cl.
*G03G 9/087* (2006.01)

(52) U.S. Cl. ..... 430/137.14; 430/137.18; 430/137.19

(58) Field of Classification Search ..... 430/137.14, 430/137.18, 137.19
See application file for complete search history.

(56) References Cited

U.S. PATENT DOCUMENTS

| | | | | |
|---|---|---|---|---|
| 6,110,636 | A * | 8/2000 | Foucher et al. | 430/137.14 |
| 2004/0146798 | A1 * | 7/2004 | Farrugia et al. | 430/137.14 |
| 2006/0063086 | A1 * | 3/2006 | Sacripante et al. | 430/109.4 |

FOREIGN PATENT DOCUMENTS

| | | |
|---|---|---|
| JP | 60-225170 | 11/1985 |
| JP | 63-282749 | 11/1988 |
| JP | 06-110252 | 4/1994 |
| JP | 06-214418 | 8/1994 |
| JP | 06-282099 | 10/1994 |
| JP | 2003-316068 | 11/2003 |
| JP | 2007-323071 | 12/2007 |

* cited by examiner

*Primary Examiner* — Hoa V Le
(74) *Attorney, Agent, or Firm* — Turocy & Watson, LLP

(57) ABSTRACT

It is intended to provide a method includes the step of forming agglomerated particles by agglomerating fine particulate mixture containing a binder resin and a colorant. In the step of forming agglomerated particles, a cationic organic coagulating agent having an average molecular weight of from 1000 to 100000 is added to a liquid dispersion containing fine particles.

7 Claims, 1 Drawing Sheet

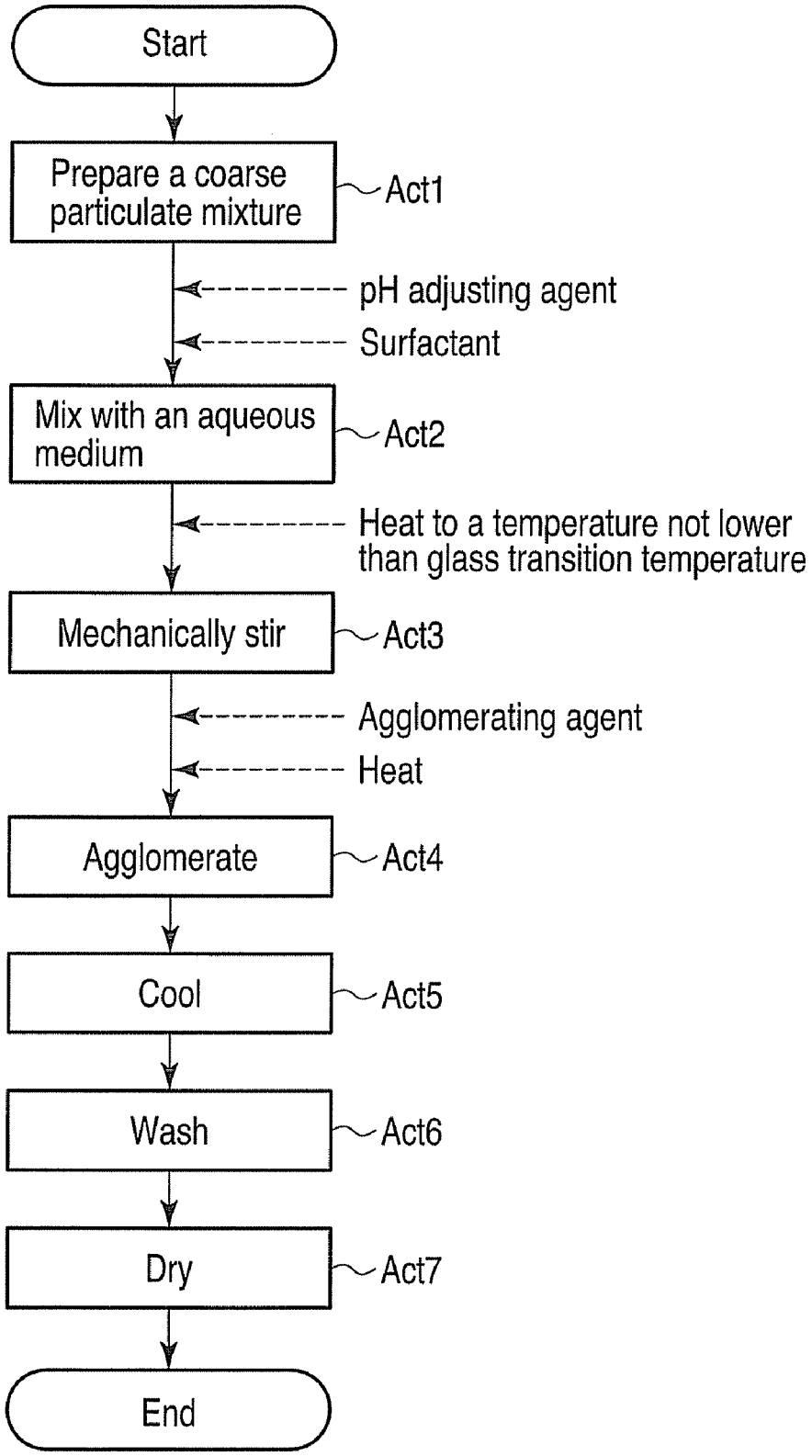
FIGURE

DEVELOPING AGENT AND METHOD FOR MANUFACTURING THE SAME

CROSS-REFERENCE TO RELATED APPLICATIONS

This application is based upon and claims the benefit of priority from U.S. Provisional Application No. 60/990,395, filed Nov. 27, 2007, the entire contents of which are incorporated herein by reference.

TECHNICAL FIELD

The present invention relates to a developing agent to be used in an electrophotographic technique and the like, and a production method thereof.

BACKGROUND

Recently, with the demand of high image quality and energy saving in an electrophotographic technique, reduction of a toner particle diameter and low-temperature fixation of a toner are proceeding.

However, it becomes difficult to further reduce a toner particle diameter using a conventional kneading pulverizing method. Therefore, as a production method of a toner capable of reducing the particle diameter, a wet-type production method of a toner attracts attention. As an example of such a wet-type production method, there is an agglomeration method as described in JP-A-60-225170, JP-A-63-282749, JP-A-6-282099, etc. This agglomeration method is a method of obtaining a toner by agglomerating fine particles of toner components such as a binder resin, a colorant and a releasing agent in a medium such as water using an agglomerating agent such as a metal salt by intentionally destroying the dispersed state of the respective fine particles thereby obtaining agglomerated particles, and thereafter fusing the surface of the agglomerated particles by subjecting the agglomerated particles to a heat treatment. This fusion step is sometimes performed simultaneously with the agglomeration step when an agglomeration temperature capable of achieving a target particle diameter is not lower than the glass transition temperature of the binder resin. In this method, toner particles are produced by agglomerating and fusing fine particles on the order of submicrometer, therefore, by using this method, toner particles having a particle diameter of 5 μm or less can be produced, and therefore a high quality image can be provided. Further, when this agglomeration method is used, by changing a condition for fusion, the shape of a toner can be controlled from an irregular shape to a spherical shape. Further, by changing a condition for agglomeration, the dispersion state of a wax, a pigment, a charge control agent and the like in the toner can be controlled at will.

On the other hand, with the advancement of low-temperature fixation of a toner, a polyester resin attracts attention in place of a conventional styrene acrylic resin as the binder resin. The use of a polyester resin can achieve both low-temperature fixability and storability of a developing agent. However, in a conventional agglomeration method, it is difficult to polymerize polyester and pulverize the resulting polymerized polyester into fine particles in water, therefore, the conventional agglomeration method could be applied only to a styrene acrylic resin through emulsion polymerization. On the other hand, as an agglomeration method suitable for a polyester resin, a method in which a polyester resin is melted by heating the resin or using a solvent, the resulting molten resin is mechanically pulverized into fine particles, and then agglomerated is proposed. JP-A-2007-323071 discloses a method of mechanically pulverizing a toner component material into fine particles without using a solvent after the toner component material is melt-kneaded or mixed. When this method is used, a colorant is uniformly dispersed in a binder resin, therefore, this method is extremely superior as a production method of a color toner. Further, because this method is solventless, it is an excellent production method capable of reducing an environmental load.

However, when this agglomeration method suitable for a polyester resin is used, a metal salt is used as an additive for destroying the dispersibility of fine particles. Therefore, when this metal salt remains in the toner, pseudo-crosslinking between molecules is accelerated and the fusibility of a toner is deteriorated. As a result, the low-temperature fixability of a toner is deteriorated.

In order to improve the above disadvantages of a metal salt, a novel agglomeration method without using a metal salt is proposed. JP-A-6-110252 proposes an agglomeration method using a quaternary ammonium salt compound, JP-A-2003-316068 proposes an agglomeration method using a polymeric agglomerating agent, and further, JP-A-6-214418 proposes an agglomeration method using an ionic surfactant with a polarity reverse to that of particles.

However, when a cationic surfactant as disclosed in JP-A-6-110252 and JP-A-6-214418 is used, because only one cationic group is present per molecule, the agglomerating property is very low, and therefore, it is necessary to add the cationic surfactant in a large amount. Due to this, the amount of the cationic surfactant remaining in the toner is increased, and the chargeability of the toner is deteriorated due to the hydrophilic group of the surfactant. Further, when a polymeric agglomerating agent having a molecular weight of 100000 or more as disclosed in JP-A-6-110252 and JP-A-2003-316068 is used, because the molecule is too large, an increase in the viscosity of the system or crosslinking between particles is caused, and coarse particles and unagglomerated particles are liable to be formed, and it is difficult to obtain a uniform particle size distribution.

SUMMARY

An object of the present invention is to provide a developing agent which has a favorable chargeability and low-temperature fixability and also is capable of reducing a particle diameter.

The production method of a developing agent according to the invention comprises:

forming a liquid dispersion of a particulate mixture by dispersing a particulate mixture containing at least a binder resin and a colorant in an aqueous medium;

forming toner component fine particles by pulverizing the particulate mixture into fine particles by subjecting the liquid dispersion to mechanical shearing; and forming agglomerated particles by adding a cationic organic coagulating agent having an average molecular weight of from 1000 to 100000 to a liquid dispersion containing the fine particles and agglomerating the fine particles.

Further, the developing agent according to the invention comprises toner particles containing a binder resin, a colorant and a cationic organic coagulating agent having an average molecular weight of from 1000 to 100000.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWING

The accompanying drawing, which is incorporated in and constitutes a part of the specification, illustrates embodiments of the invention, and together with the general description given above and the detailed description of the embodiments given below, serves to explain the principles of the invention.

The FIGURE is a flow diagram for illustrating one example of a production method of a developing agent according to the invention.

DETAILED DESCRIPTION

The production method of a developing agent of the present invention is a method comprising the step of forming agglomerated particles by agglomerating fine particulate mixture containing at least a binder resin and a colorant, and in the step of forming agglomerated particles, a cationic organic coagulating agent having an average molecular weight of from 1000 to 100000 is added to a liquid dispersion containing fine particles.

Further, the developing agent according to the invention is a developing agent obtained by the above-mentioned method and contains toner particles obtained by fusing an agglomerate of toner component fine particles containing a binder resin, a colorant and a cationic organic coagulating agent having an average molecular weight of from 1000 to 100000.

The developing agent of the invention contains a cationic organic coagulating agent used for agglomerating toner component fine particles in the production.

If this cationic organic coagulating agent is used, when toner component fine particles are agglomerated, a small addition amount of this additive can agglomerate the toner component fine particles and also allows the particle diameter of the resulting agglomerated particles to be uniform. Further, the concomitant use of a monovalent metal salt with the cationic organic coagulating agent can achieve a more uniform particle size distribution.

The fine particulate mixture can be obtained by dispersing a particulate mixture containing at least a binder resin and a colorant in an aqueous medium thereby forming a liquid dispersion of the particulate mixture, and subjecting the liquid dispersion to mechanical shearing thereby pulverizing the particulate mixture into fine particles.

The fine particulate mixture can also be obtained by mixing fine particles containing a binder resin and fine particles containing a colorant.

Hereinafter, the invention will be described in further detail with reference to the drawing.

The FIGURE is a flow diagram for illustrating one example of a production method of a developing agent according to the first and second aspects of the invention.

As shown in the FIGURE, in the production method of a developing agent of the invention, first, coarse particulate mixture containing a binder resin and a colorant is prepared (Act 1).

The coarse particulate mixture can be obtained by the step of melt-kneading a mixture containing a binder resin and a colorant and coarsely pulverizing the mixture, or the step of granulating a mixture containing a binder resin and a colorant.

Coarse particles are obtained by coarsely pulverizing the coarse particulate mixture.

The coarse particles have a volume average particle diameter of, for example, from 0.05 mm to 10 mm. When the volume average particle diameter is less than 0.05 mm, strong stirring is required for dispersing the mixture in an aqueous medium, and foam generated by stirring tends to decrease the dispersion of the mixture. When the volume average particle diameter exceeds 10 mm, because the particle diameter is larger than a gap provided in a shearing portion of a mechanical stirrer, the particles are caught in the shearing portion or a difference in the applied energy is caused between the inside and the outside of the mixture, therefore, particles with a nonuniform composition or particle diameter tend to be formed.

The coarse particulate mixture more preferably has a volume average particle diameter of from 0.1 mm to 5 mm.

Subsequently, a liquid dispersion of the coarse particulate mixture is formed by dispersing the coarse particulate mixture in an aqueous medium (Act 2).

In the step of forming the liquid dispersion of the coarse particulate mixture, at least one member of a surfactant and a pH adjusting agent can optionally be added to the aqueous medium.

By the addition of a surfactant, the coarse particulate mixture can be easily dispersed in the aqueous medium due to the action of the surfactant adsorbed on the surface of the mixture. Further, by the addition of a pH adjusting agent, the degree of dissociation of a dissociative functional group on the surface of the mixture is increased or the polarity is increased, and therefore, the self-dispersibility can be improved.

Subsequently, fine particles are formed by subjecting the resulting liquid dispersion to mechanical shearing and pulverizing the coarse particulate mixture into fine particles (Act 3).

The mechanical shearing can be performed by heating the mixture to a temperature not lower than the glass transition temperature of the binder resin.

According to the invention, by performing the mechanical shearing at a temperature not lower than the glass transition temperature of the binder resin in the aqueous medium, the fluidity of the binder resin in the coarse particulate mixture can be secured, and the mixture can be pulverized into fine particles while coating the surface of the dispersed particles with a desired material. In this way, toner particles having a more uniform surface composition can be obtained unlike toner particles obtained by a pulverization method.

According to the invention, by adjusting the treatment temperature and treatment time of the mechanical shearing, the number of revolutions of the stirrer or the like, the size of the obtained fine particles can be controlled.

The fine particles preferably have a volume average particle diameter of from 0.01 μm to 2 μm.

After the mechanical shearing, agglomerated particles are formed by agglomerating the fine particles (Act 4).

In order to form the agglomerated particles, a cationic organic coagulating agent having an average molecular weight of from 1000 to 100000 can be added to the liquid dispersion as an agglomerating agent.

Further, in order to fuse the agglomerated particles, this liquid dispersion can be heated to a temperature higher than the glass transition temperature of the binder resin by, for example, about 5 to 80° C.

In the step of forming agglomerated particles, a cationic organic coagulating agent and a metal salt can be further added.

The metal salt to be used in the invention is preferably a monovalent metal salt.

The agglomerated particles preferably have a volume average particle diameter of from 1 to 15 μm.

The agglomerated particles preferably have a degree of circularity of from 0.8 to 1.0.

After the agglomerated particles are formed, the liquid dispersion of the agglomerated particles is cooled to, for example, 5° C. or a temperature not higher than the glass transition temperature of the binder resin (Act 5), and thereafter, washing is performed using, for example, a filter press (Act 6), followed by drying (Act 7), whereby toner particles can be obtained.

Examples of the cationic organic coagulating agent to be used in the invention include dicyan-based organic coagulating agents, allylamine-based organic coagulating agents, polyalkylene polyamine-based organic coagulating agents, and other polycationic organic coagulating agents, all of which have a molecular weight ranging from 1000 to 100000.

When an organic coagulating agent having a molecular weight of 100000 or more is used, because the molecule is too large, an increase in the viscosity of the dispersion system or crosslinking between particles is caused, and coarse particles and unagglomerated particles are liable to be formed, and it tends to become difficult to obtain a uniform particle size distribution. Further, when the molecular weight is less than 1000, the addition amount of the organic coagulating agent is increased and the chargeability of the toner tends to be deteriorated.

Examples of the dicyan-based organic coagulating agent include dicyandiamide-formalin polycondensates, dicyandiamide-dialkylene polyamine polycondensates and salts thereof.

Examples of the allylamine-based organic coagulating agent include allylamine salt polymers, diallylamine salt polymers such as polydiallyl dimethyl ammonium chloride, diallylamine salt-$SO_2$ copolymers, dialkylallylamine salt polymers, dialkylallylamine salt-$SO_2$ copolymers, alkyldiallylamine salt polymers, alkylamine salt polymers and alkyldiallylamine salt-$SO_2$ copolymers.

Examples of the polyalkylene polyamine-based organic coagulating agent include polyethyleneimine salts, tetraethylene pentamine salts, ethylene dichloride-ammonia condensates, propylene dichloride-ammonia condensates, ethylene dichloride-dimethylamine condensates, propylene dichloride-dibutylamine condensates, ethylene dichloride-aniline condensates, epichlorohydrin-ammonia condensates, epichlorohydrin-dialkylamine condensates, epichlorohydrin-diphenylamine condensates, tetrahydrofurfuryl chloride-dialkylamine condensates and allylamine addition polymers.

Examples of other polycationic organic coagulating agents include aniline-formalin polycondensate hydrochlorides, polyvinyl benzyl dimethyl ammonium chloride and polyvinyl imidazoline (salt).

Further, as a salt of any of the above-mentioned coagulating agents, for example, a hydrochloride, a hydrobromate, a hydroiodide, a sulfate, a sulfite, a phosphate, a nitrate, an acetate, a methyl chloride salt, a dimethyl sulfate, a benzyl chloride salt or the like can be used.

Among the above-mentioned coagulating agents, for example, when a quaternary ammonium salt such as polyhydroxy propyldimethyl ammonium chloride or polydiallyl dimethyl ammonium chloride is used, the particle size distribution can be made uniform.

As the metal salt to be used in the invention, a monovalent salt such as sodium chloride, potassium chloride, a lithium chloride or sodium sulfate, a divalent salt such as magnesium chloride, calcium chloride, magnesium sulfate, calcium nitrate, zinc chloride, ferric chloride or ferric sulfate, or a trivalent salt such as aluminum sulfate or aluminum chloride can be used. However, when a monovalent salt among them is used, a change in the heat characteristic of a toner can be suppressed to the minimum, and the particle size distribution becomes more uniform.

The average molecular weight of the organic coagulating agent of the invention is calculated using the following viscosity equation from the intrinsic viscosity measured in a 1 N aqueous solution of $NaNO_3$ at 30° C.

$$[\eta](dl/g)=3.73\times10-4\times[Mw]0.66 \text{ (in terms of polyacrylamide)}$$

The toner component fine particles to be used in the invention refers to particles containing at least a binder resin and a colorant which are essential for a toner, and refers to fine particles containing a releasing agent, a charge control agent or the like as needed. These fine particles are basically dispersed in a medium mainly containing water.

The particle diameter of the toner component fine particles is sufficiently smaller than that of a toner which is desired to be obtained finally, and is preferably from 0.01 μm to 2 μm.

The liquid dispersion of the toner component fine particles can be prepared by a known method. Examples of the preparation method of the liquid dispersion of the toner component fine particles include a polymerization method, a phase inversion emulsification method and a mechanical pulverization method. Examples of the polymerization method include polymerization methods of a monomer or a resin intermediate such as emulsion polymerization, seed polymerization, mini-emulsion polymerization, suspension polymerization, interfacial polymerization and in-site polymerization. Examples of the phase inversion emulsification method include a method in which a binder resin is softened using a solvent, an alkali, or a surfactant or by heating thereby forming an oil phase, and then an aqueous phase mainly containing water is added thereto thereby obtaining particles. Examples of the mechanical pulverization method include a method in which a binder resin is softened using a solvent or by heating, and then the mixture is mechanically pulverized into fine particles in an aqueous medium using a high-pressure pulverizer, a rotor-stator stirrer or the like. A liquid dispersion of colorant particles, a liquid dispersion of releasing agent particles and a liquid dispersion of charge control agent particles can be obtained by, for example, a mechanical pulverization method in which the respective material is mechanically pulverized into fine particles in an aqueous medium using a high-pressure pulverizer, a rotor-stator stirrer, a medium pulverizer or the like.

On the other hand, other than the method in which the respective fine particles are separately prepared, there is also a method in which the toner component material is melt-kneaded or mixed, and then the resulting mixture is mechanically pulverized into fine particles in an aqueous medium using a high-pressure pulverizer, a rotor-stator stirrer, a medium pulverizer or the like. When this method is used, the toner component fine particles can be prepared at a time, and therefore, the step can be simplified, and further, the colorant can be uniformly dispersed in the binder resin. Therefore, this method is an extremely superior production method of a color toner.

The use of, for example, a rotor-stator stirrer or a high-pressure pulverizer when the coagulating agent to be used in the invention is mixed with the toner component fine particles can suppress the formation of a large agglomerate occurring if the toner component fine particles with a low dispersion stability are used, and consequently, the resulting toner tends to have a sharp particle size distribution.

The method of agglomerating the toner component fine particles of the invention is a method in which agglomeration is effected by destroying the stability of the toner component fine particles by the addition of the above-mentioned agglomerating agent, pH adjustment, the addition of a surfactant, heating or the like performed for a liquid dispersion of the toner component fine particles and the resulting agglomerate of particles is allowed to grow so as to have a toner particle diameter.

The addition amount of the coagulating agent varies depending on the dispersion stability of the toner component fine particles, and when the dispersion stability is high, the addition amount is large, and when the dispersion stability is low, the addition amount is small.

According to the invention, when the toner component fine particles are agglomerated, a smaller addition amount of the coagulating agent than that of a metal salt to be used as an agglomerating agent in a conventional agglomeration method can agglomerate the toner component fine particles.

For example, in a system in which the solid content of the toner component fine particles is from 5 to 10% and a common metal salt such as sodium chloride is added in an amount of from 2 to 10%, by adding the cationic organic coagulating agent in an amount of only from 0.01 to 2% in place of a metal salt, agglomerated particles can be obtained. Further, when a monovalent metal salt such as sodium chloride is used in combination with the cationic organic coagulating agent, by adding as the cationic organic coagulating agent, polydiallyl dimethyl ammonium chloride having a molecular weight of 9000 in an amount of from 0.01 to 2% and as the metal salt, sodium chloride in an amount of from 0.01 to 2%, agglomerated particles can be obtained.

Further, the developing agent according to the invention contains the cationic organic coagulating agent in an amount of from 0.0001 to 20%.

The pH adjustment or addition of a surfactant is performed as needed. This procedure is employed when the agglomerating property of the toner component fine particles is adjusted. Because the agglomeration is accelerated as the temperature is higher, heating is also performed when the agglomerating property is adjusted. By adjusting these agglomerating factors, the agglomerated particles having a finally required toner particle diameter are prepared. Thereafter, the pH adjustment or addition of a surfactant or the like is performed for the agglomerated particles as needed, and the resulting mixture is heated to a temperature not lower than the Tg of the binder resin, whereby the surface of the agglomerated particles is fused and toner particles are formed. At this time, when the agglomeration temperature is not lower than the Tg of the binder resin, agglomeration and fusion can also be performed simultaneously. Further, a stirring condition for the agglomeration and fusion greatly affects the particle diameter and the particle size distribution. The stirring speed is preferably set to a value which provides proper shearing. When the shearing is too low, the particle diameter becomes large, and also coarse particles are liable to be formed.

On the other hand, when the shearing is too high, the particle diameter becomes small, and fine powder is liable to be formed. Further, a baffle is preferably installed in a reactor. The baffle has an effect of suppressing foam entrapment, an effect of making the stirring state in the reactor uniform and an effect of increasing the shearing.

After the steps of agglomerating the toner component fine particles and fusing the resulting agglomerated particles, the resulting toner particles are washed and dried, and then mixed with an external additive as needed, whereby the toner according to the invention is obtained.

As a production apparatus to be used in the invention, a known apparatus can be used, and examples thereof include the following apparatuses.

A kneader is not particularly limited as long as it can perform melt-kneading, however, examples thereof include a single screw extruder, a twin screw extruder, a pressure kneader, a Banbury mixer and a Brabender mixer. Specific examples thereof include FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Ltd.), PCM (manufactured by Ikegai, Ltd.), TEX (manufactured by the Japan Steel Works, Ltd.), TEM (manufactured by Toshiba Machine Co., Ltd.), ZSK (manufactured by Warner Inc.) and KNEADEX (manufactured by Mitsui Mining Co., Ltd.).

A crusher is not particularly limited as long as it is a dry-type crusher and can perform crushing, however, examples thereof include a ball mill, an atomizer, a bantam mill, a pulverizer, a hammer mill, a roll crusher, a cutter mill and a jet mill.

A pulverizer is not particularly limited as long as it is a wet-type pulverizer and can perform pulverization, however, examples thereof include high-pressure pulverizers such as Nanomizer (manufactured by Yoshida Kikai Co., Ltd.), Ultimizer (manufactured by Sugino Machine Limited), NANO 3000 (manufactured by Beryu Co., Ltd.), Microfluidizer (manufactured by Mizuho Industry Co., Ltd.) and Homogenizer (manufactured by Izumi Food Machinery Co., Ltd.); rotor-stator stirrers such as Ultra Turrax (manufactured by IKA Japan KK), TK Auto Homomixer (manufactured by Primix Corporation), TK Pipeline Homo Mixer (manufactured by Primix Corporation), TK Filmics (manufactured by Primix Corporation), Clear Mix (manufactured by M. Technique Co., Ltd.), Clear SS5 (manufactured by M. Technique Co., Ltd.), Cavitron (manufactured by Eurotec, Ltd.) and Fine Flow Mill (manufactured by Pacific Machinery & Engineering Co., Ltd.); and medium stirrers such as Viscomill (manufactured by Imex Co., Ltd.), Apex Mill manufactured by Kotobuki Industries Co., Ltd., Star Mill (manufactured by Ashizawa Finetech Co., Ltd.), DCP Superflow (manufactured by Nippon Eirich Co., Ltd.), MP Mill (manufactured by Inoue Manufacturing Co., Ltd.), Spike Mill (manufactured by Inoue Manufacturing Co., Ltd.), Mighty mill (manufactured by Inoue Manufacturing Co., Ltd.) and SC Mill (manufactured by Mitsui Mining Co., Ltd.). Any of these pulverizers can also be used for mixing the toner component particles and the agglomerating agent.

As a washing apparatus, for example, a centrifuge, a filter press or the like is preferably used. As a washing liquid, for example, water, ion exchanged water, purified water, water adjusted to an acidic pH, water adjusted to an alkaline pH or the like is used.

As a dryer, for example, a vacuum dryer, an air-flow dryer, a fluidized dryer or the like is preferably used.

Examples of a mixer include Henschel mixer (manufactured by Mitsui Mining Co., Ltd.), Super mixer (manufactured by Kawata Manufacturing Co., Ltd.), Libocone (manufactured by Okawara Manufacturing Co., Ltd.), Nauta mixer (manufactured by Hosokawa Micron, Co., Ltd.), Turbulizer (manufactured by Hosokawa Micron, Co., Ltd.), Cyclomix (manufactured by Hosokawa Micron, Co., Ltd.), Spiral Pin Mixer (manufactured by Pacific Machinery & Engineering Co., Ltd.) and Lodige Mixer (manufactured by Matsubo Corporation).

As the material to be used in the invention, any material known as a toner material such as a polymerizable monomer, a chain transfer agent, a cross-linking agent, a polymerization initiator, a surfactant, a pH adjusting agent, a resin, a colorant or a releasing agent can be used.

As a vinyl polymerizable monomer, aromatic vinyl monomers such as styrene, methylstyrene, methoxystyrene, phenylstyrene and chlorostyrene; ester monomers such as methyl acrylate, ethyl acrylate, butyl acrylate, methyl methacrylate, ethyl methacrylate and butyl methacrylate; monomers containing a carboxylic acid such as acrylic acid, methacrylic acid, fumaric acid and maleic acid; amine monomers such as aminoacrylate, acrylamide, methacrylamide, vinylpyridine and vinylpyrrolidone; and derivatives thereof can be used alone or by mixing two or more of them. As for a polycondensation polymerizable monomer, as an alcohol component, aliphatic diols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,4-butenediol, 1,2-propanediol, 1,3-butanediol, neopentyl glycol and 2-butyl-2-ethyl-1,3-propanediol; aromatic diols such as bisphenol A alkylene oxide adducts including polyoxypropylene (2.2)-2,2-bis(4-hydroxyphenyl)propane and polyoxyethylene (2.2)-2,2-bis(4-hydroxyphenyl)propane; polyhydric alcohols having a valence of 3 or more such as glycerin and pentaerythritol; and derivatives thereof can be used alone or by mixing two or more of them. As a carboxylic acid component, aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecyl succinic acid and n-dodecenyl succinic acid; alicyclic dicarboxylic acids such as cyclohexane dicarboxylic acids; aromatic dicarboxylic acids such as phthalic acid, isophthalic acid and terephthalic acid; polyvalent carboxylic acids having a valence of 3 or more such as trimellitic acid and pyromellitic acid; and derivatives thereof can be used alone or by mixing two or more of them.

As the chain transfer agent, carbon tetrachloride, dodecylmercaptan, trichlorobromomethane, dodecanethiol or the like is used.

As the cross-linking agent, a cross-linking agent having two or more unsaturated bonds such as divinylbenzene, divinyl ether, divinyl naphthalene or diethylene glycol methacrylate is used.

The polymerization initiator is required to be selected according to the polymerization method, and there are two types of polymerization initiators, a water-soluble initiator and an oil-soluble initiator. As the water-soluble initiator, a persulfate such as potassium persulfate or ammonium persulfate, an azo compound such as 2,2-azobis(2-aminopropane), hydrogen peroxide, benzoyl peroxide or the like is used. As the oil-soluble initiator, an azo compound such as azobisisobutyro nitrile or azobisdimethylvalero nitrile, a peroxide such as benzoyl peroxide or dichlorobenzoyl peroxide, or the like is used. Further, if necessary, a redox initiator can also be used.

As the surfactant, an anionic surfactant, a cationic surfactant, an amphoteric surfactant, a nonionic surfactant or the like can be used. Examples of the anionic surfactant include fatty acid salts, alkyl sulfates, polyoxyethylene alkyl ether sulfates, alkyl benzene sulfonates, alkyl naphthalene sulfonates, dialkyl sulfosuccinates, alkyl diphenyl ether disulfonates, polyoxyethylene alkyl ether phosphates, alkenyl succinates, alkane sulfonates, naphthalene sulfonate-formalin condensate salts, aromatic sulfonate-formalin condensate salts and polycarboxylic acids. Examples of the cationic surfactant include alkylamine salts and alkyl quaternary ammonium salts. Examples of the amphoteric surfactant include alkyl betaines and alkylamine oxides. Examples of the nonionic surfactant include polyoxyethylene alkyl ethers, polyoxyalkylene alkyl ethers, polyoxyethylene derivatives, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene hydrogenated castor oil, polyoxyethylene alkylamines and alkyl alkanol amides. These can be used alone or in combination of two or more.

As the pH adjusting agent, an acid such as hydrochloric acid, sulfuric acid, acetic acid or phosphoric acid, or an alkali such as sodium hydroxide, potassium hydroxide, ammonia or an amine compound can be used. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane and N,N-diethyl-1,3-diaminopropane.

Examples of the resin include styrene resins such as polystyrene, styrene-butadiene copolymers and styrene-acrylic copolymers, ethylene resins such as polyethylene, polyethylene-vinyl acetate copolymers, polyethylene-norbornene copolymers and polyethylene-vinyl alcohol copolymers, polyester resins, acrylic resins, phenol resins, epoxy resins, allyl phthalate resins, polyamide resins and maleic acid resins. These resins may be used alone or in combination of two or more types. Further, the glass transition temperature of these resins is preferably from 40 to 80° C., and the softening temperature thereof is preferably from 80 to 180° C.

As the colorant, a carbon black, an organic or inorganic pigment or dye can be exemplified. Examples of the carbon black include acetylene black, furnace black, thermal black, channel black and Ketjen black. Examples of a yellow pigment include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183 and 185, and C.I. Vat Yellow 1, 3 and 20. These can be used alone or in admixture thereof. Further, examples of a magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209 and 238, C.I. Pigment Violet 19, and C.I. Vat Red 1, 2, 10, 13, 15, 23, 29 and 35. These can be used alone or in admixture thereof. Further, examples of a cyan pigment include C.I. Pigment Blue 2, 3, 15, 16 and 17, C.I. Vat Blue 6, and C.I. Acid Blue 45. These can be used alone or in admixture thereof.

Examples of the releasing agent include aliphatic hydrocarbon waxes such as low molecular weight polyethylene, low molecular weight polypropylene, polyolefin copolymers, polyolefin waxes, microcrystalline waxes, paraffin waxes and Fischer-Tropsch waxes, oxides of an aliphatic hydrocarbon wax such as polyethylene oxide waxes or block copolymers thereof, plant waxes such as candelilla wax, carnauba wax, Japan wax, jojoba wax and rice wax, animal waxes such as bees wax, lanolin and whale wax, mineral waxes such as ozokerite, ceresin and petrolactam, waxes containing, as a main component, a fatty acid ester such as montanic acid ester wax and castor wax, and materials obtained by deoxidization of a part or the whole of a fatty acid ester such as deoxidized carnauba wax. Further, saturated linear fatty acids such as palmitic acid, stearic acid, montanic acid and long chain alkyl carboxylic acids having a long chain alkyl group, unsaturated fatty acids such as brassidic acid, eleostearic acid and parinaric acid, saturated alcohols such as stearyl alcohol, eicosyl alcohol, behenyl alcohol, carnaubyl alcohol, ceryl alcohol, melissyl alcohol and long chain alkyl alcohols having a long chain alkyl group, polyhydric alcohols such as sorbitol, fatty acid amides such as linoleic acid amide, oleic acid amide and lauric acid amide, saturated fatty acid bisamides such as methylenebisstearic acid amide, ethylenebiscaprylic acid amide, ethylenebislauric acid amide and hexamethylenebisstearic acid amide, unsaturated fatty acid amides such as ethylenebisoleic acid amide, hexamethylenebisoleic acid amide, N,N'-dioleyladipic acid amide and N,N'-dioleylsebaccic acid amide, aromatic bisamides such as m-xylenebisstearic acid amide and N,N'-distearylisophthalic acid amide, fatty acid metal salts (generally called metallic soaps) such as calcium stearate, calcium laurate, zinc stearate and magnesium stearate, waxes obtained by grafting of a vinyl monomer such as styrene or acrylic acid on an aliphatic hydrocarbon wax, partially esterified products of a fatty acid and a polyhydric alcohol such as behenic acid monoglyceride, and methyl ester compounds having a hydroxyl group obtained by hydrogenation of a vegetable fat and oil can be exemplified.

Further, a charge control agent, an external additive or the like can be added as needed.

As the charge control agent, for example, a metal-containing azo compound is used, and the metal element is preferably a complex or a complex salt of iron, cobalt or chromium or a mixture thereof. Other than these, a metal-containing salicylic acid derivative compound can also be used, and the metal element is preferably a complex or a complex salt of zirconium, zinc, chromium or boron or a mixture thereof.

As the external additive to be added to the surface of the toner particles, inorganic fine particles can be added and mixed in the surface of the toner particles in an amount of from 0.01 to 20% by weight based on the total weight of the toner for adjusting the fluidity or chargeability of the toner particles. As such inorganic fine particles, silica, titania, alumina, strontium titanate, tin oxide and the like can be used alone or by mixing two or more of them. It is preferred that as the inorganic fine particles, inorganic fine particles surface-treated with a hydrophobizing agent are used from the viewpoint of improvement of environmental stability. Further, other than such inorganic oxides, resin fine particles having a particle diameter of 1 μm or less may be externally added for improving the cleaning property.

Hereinafter, Examples will be described. The molecular weight of a binder resin is determined by the GPC method (in terms of polystyrene).

| Preparation of primary particles A | |
|---|---|
| Polyester resin (Mw: 25000) | 90 parts by weight |
| P.B. 15:3 (manufactured by Clariant Co., Ltd.) | 5 parts by weight |
| Rice wax | 5 parts by weight |

The above ingredients were mixed, and the resulting mixture was melt-kneaded with a twin screw kneader at 120° C., whereby a kneaded material was obtained.

The thus obtained kneaded material was coarsely pulverized into a volume average particle diameter of 1.2 mm with a hammer mill manufactured by Nara Machinery Co., Ltd., whereby coarse particles were obtained.

30 parts by weight of the resulting coarse particles, 3 parts by weight of sodium dodecylbenzene sulfonate as an anionic surfactant, 1 part by weight of triethylamine as an amine compound and 66 parts by weight of ion exchanged water were placed in Clear Mix and dispersed, whereby a liquid dispersion was prepared.

After the liquid dispersion in the Clear Mix was heated to 120° C., the rotation speed of the Clear Mix was set to 6,000 rpm, and the liquid dispersion was mechanically stirred for 30 minutes. After completion of the mechanical stirring, the liquid dispersion was cooled to room temperature. The volume average particle diameter of the thus obtained particles was measured with SALD-7000 manufactured by Shimadzu Corporation and found to be 0.54 μm.

| Preparation of primary particles B | |
|---|---|
| Polyester resin (Mw: 25000) | 90 parts by weight |
| P.B. 15:3 (manufactured by Clariant Co., Ltd.) | 5 parts by weight |
| Rice wax | 5 parts by weight |

The above ingredients were mixed, and the resulting mixture was melt-kneaded with a twin screw kneader at 120° C., whereby a kneaded material was obtained.

The thus obtained kneaded material was coarsely pulverized into a volume average particle diameter of 0.1 mm or less with a bantam mill manufactured by Hosokawa Micron Corporation, whereby coarse particles were obtained.

30 parts by weight of the resulting coarse particles, 3 parts by weight of sodium dodecylbenzene sulfonate as an anionic surfactant, 1 part by weight of triethylamine as an amine compound and 66 parts by weight of ion exchanged water were mixed, whereby a liquid dispersion was prepared.

The thus obtained liquid dispersion was treated at 150 MPa and 180° C. with NANO 3000, whereby particles were obtained. The volume average particle diameter of the thus obtained particles was measured with SALD-7000 manufactured by Shimadzu Corporation and found to be 0.45 μm.

Preparation of Polyester Resin Particles

A polyester resin (Mw: 25000) was coarsely pulverized into a volume average particle diameter of 0.1 mm or less with a bantam mill manufactured by Hosokawa Micron Corporation, whereby coarse particles were obtained.

30 parts by weight of the resulting coarse particles, 3 parts by weight of sodium dodecylbenzene sulfonate as an anionic surfactant, 1 part by weight of triethylamine as an amine compound and 66 parts by weight of ion exchanged water were mixed, whereby a liquid dispersion was prepared.

The thus obtained liquid dispersion was treated at 150 MPa and 180° C. with NANO 3000, whereby fine particles were obtained. The volume average particle diameter of the thus obtained fine particles was measured with SALD-7000 manufactured by Shimadzu Corporation and found to be 0.25 μm.

Preparation of Styrene Acrylic Resin Particles

A polymer material with the following composition was prepared.

| | |
|---|---|
| Styrene | 35 parts by weight |
| Butyl acrylate | 3 parts by weight |
| Acrylic acid | 0.5 part by weight |
| Dodecanethiol | 2 parts by weight |
| Carbon tetrabromide | 0.5 part by weight |

The above polymer material was mixed, and the resulting mixture, 0.5 part by weight of polyoxyethylene alkyl ether (HLB 16) and 1 part by weight of sodium dodecylbenzene sulfonate and 55.5 parts by weight of ion exchanged water were mixed and emulsified with a homogenizer. Then, 2 parts by weight of a 10% ammonium persulfate solution was gradually added thereto, and the resulting mixture was subjected to nitrogen replacement. Then, emulsion polymerization was performed at 70° C. for 5 hours, whereby a liquid dispersion of styrene acrylic resin emulsified particles having a volume average particle diameter of 105 nm, a Tg of 60° C. and a Mw of 32000 was obtained.

| Preparation of colorant particles | |
|---|---|
| P.B. 15:3 manufactured by Clariant Co., Ltd. | 30 parts by weight |
| Sodium dodecylbenzene sulfonate | 3 parts by weight |
| Ion exchanged water | 67 parts by weight |

The above ingredients were dispersed using a homogenizer manufactured by IKA Japan KK, and the resulting dispersion was treated at 180 MPa with a nanomizer, whereby a liquid dispersion of colorant particles having a volume average particle diameter of 150 nm was obtained.

| Preparation of releasing agent particles | |
|---|---|
| Rice wax | 30 parts by weight |
| Sodium dodecylbenzene sulfonate | 3 parts by weight |
| Ion exchanged water | 67 parts by weight |

After the above ingredients were dispersed using a homogenizer (manufactured by IKA Japan KK) while heating to about 90° C., the resulting dispersion was treated at 180 MPa and 150° C. with a nanomizer, whereby a liquid dispersion of releasing agent particles having a volume average particle diameter of 100 nm was obtained.

EXAMPLE 1

A liquid dispersion of primary particles was prepared by mixing 17 parts by weight of the primary particles A and 34 parts by weight of ion exchanged water. This liquid dispersion was stirred with a homogenizer while gradually adding 45 parts by weight of a 0.5% aqueous solution of polydiallyl dimethyl ammonium chloride (molecular weight: 9000) thereto. Thereafter, the liquid dispersion was heated to 50° C. while stirring with a paddle blade, whereby agglomerated particles having a volume average diameter of 5.5 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.5 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.5 μm, the 50% number average diameter Dp was 4.7 μm, and Dp/Dv was 0.85.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 2

A liquid dispersion of primary particles was prepared by mixing 17 parts by weight of the primary particles B and 34 parts by weight of ion exchanged water. This liquid dispersion was stirred with a homogenizer while gradually adding 45 parts by weight of a 0.5% aqueous solution of polydiallyl dimethyl ammonium chloride (molecular weight: 9000) thereto. Thereafter, the liquid dispersion was heated to 50° C. while stirring with a paddle blade, whereby agglomerated particles having a volume average diameter of 4.5 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 4.5 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 4.5 μm, the 50% number average diameter Dp was 3.8 μm, and Dp/Dv was 0.84.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 3

A liquid dispersion of primary particles was prepared by mixing 17 parts by weight of the primary particles A and 34 parts by weight of ion exchanged water. This liquid dispersion was stirred with a homogenizer while gradually adding 45 parts by weight of a mixed aqueous solution containing 0.2% polydiallyl dimethyl ammonium chloride (molecular weight: 9000) and 1% sodium chloride thereto. Thereafter, the liquid dispersion was heated to 50° C. while stirring with a paddle blade, whereby agglomerated particles having a volume average diameter of 5.6 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.6 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.6 μm, the 50% number average diameter Dp was 5.0 μm, and Dp/Dv was 0.89.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 4

A liquid dispersion of primary particles was prepared by mixing 17 parts by weight of the primary particles A and 34 parts by weight of ion exchanged water. This liquid dispersion was stirred with a homogenizer while gradually adding 45 parts by weight of a mixed aqueous solution containing 0.1% polydiallyl dimethyl ammonium chloride (molecular weight: 30000) and 1% sodium chloride thereto. Thereafter, the liquid dispersion was heated to 50° C. while stirring with a paddle blade, whereby agglomerated particles having a volume average diameter of 5.4 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.4 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.4 μm, the 50% number average diameter Dp was 4.7 μm, and Dp/Dv was 0.87.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 5

A liquid dispersion of primary particles was prepared by mixing 17 parts by weight of the primary particles A and 34 parts by weight of ion exchanged water. This liquid dispersion was stirred with a homogenizer while gradually adding 45 parts by weight of a mixed aqueous solution containing 0.3% polydiallyl dimethyl ammonium chloride (molecular weight: 4000) and 1% sodium chloride thereto. Thereafter, the liquid dispersion was heated to 50° C. while stirring with a paddle blade, whereby agglomerated particles having a volume average diameter of 5.0 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.0 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.0 μm, the 50% number average diameter Dp was 4.5 μm, and Dp/Dv was 0.90.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 6

A liquid dispersion of primary particles was prepared by mixing 17 parts by weight of the primary particles A and 34 parts by weight of ion exchanged water. After the pH of the resulting liquid dispersion was adjusted to 10 with a sodium hydroxide, the liquid dispersion was stirred with a homogenizer while gradually adding 45 parts by weight of a mixed aqueous solution containing 0.2% polyhydroxy propyldimethyl ammonium chloride (molecular weight: 10000) and 1% sodium chloride thereto. Thereafter, the liquid dispersion was heated to 50° C. while stirring with a paddle blade, whereby agglomerated particles having a volume average diameter of 5.0 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.0 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.5 μm, the 50% number average diameter Dp was 4.8 μm, and Dp/Dv was 0.87.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 7

15.3 parts by weight of the polyester resin particles, 0.85 part by weight of the colorant particles, 0.85 part by weight of the releasing agent particles and 34 parts by weight of ion exchange water were mixed, and the pH of the resulting liquid mixture was adjusted to 5 with hydrochloric acid. Then, the liquid mixture was stirred with a homogenizer while gradually adding 45 parts by weight of a mixed aqueous solution containing 0.2% polydiallyl dimethyl ammonium chloride (molecular weight: 9000) and 1% sodium chloride thereto. Thereafter, the liquid mixture was heated to 50° C. while stirring with a paddle blade, whereby agglomerated particles having a volume average diameter of 5.2 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.2 μm was obtained.

Washing of the solid in the obtained solution was performed by repeating filtration and washing with ion exchanged water until the electrical conductivity of the filtrate became 50 pS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.2 μm, the 50% number average diameter Dp was 4.6 μm, and Dp/Dv was 0.88.

The electrophotographic toner was placed in a multifunction machine e-STUDIO 281c manufactured by Toshiba Tec Corporation modified for evaluation, and the image quality and fixability were evaluated. As a result, good results were obtained for both image quality and fixability.

The obtained results are shown in the following Table 1.

EXAMPLE 8

15.3 parts by weight of the styrene acrylic resin particles, 0.85 part by weight of the colorant particles, 0.85 part by weight of the releasing agent particles and 34 parts by weight of ion exchange water were mixed, and the resulting liquid mixture was stirred with a homogenizer while gradually adding 45 parts by weight of a mixed aqueous solution containing 0.2% polydiallyl dimethyl ammonium chloride (molecular weight: 9000) and 1% sodium chloride thereto. Thereafter, the liquid mixture was heated to 50° C. while stirring with a paddle blade, whereby agglomerated particles having a volume average diameter of 5.0 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.0 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.0 μm, the 50% number average diameter Dp was 4.4 μm, and Dp/Dv was 0.88.

The electrophotographic toner was placed in a multifunction machine e-STUDIO 281c manufactured by Toshiba. Tec Corporation modified for evaluation, and the image quality and fixability were evaluated. As a result, good results were obtained for both image quality and fixability, however, the fixability was slightly inferior to that of Examples 1 to 7.

The obtained results are shown in the following Table 1.

COMPARATIVE EXAMPLE 1

17 parts by weight of the primary particles A and 34 parts by weight of ion exchanged water were mixed, and the resulting liquid mixture was stirred with a homogenizer while gradually adding 45 parts by weight of a 0.5% aqueous solution of aluminum sulfate thereto. Thereafter, the liquid mixture was heated to 50° C. while stirring with a paddle blade, whereby agglomerated particles having a volume average diameter of 5.8 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 6.0 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 6.0 μm, the 50% number average diameter Dp was 4.8 μm, and Dp/Dv was 0.80.

The electrophotographic toner was placed in a multifunction machine e-STUDIO 281c manufactured by Toshiba Tec Corporation modified for evaluation, and the image quality and fixability were evaluated. As a result, the image quality was deteriorated due to coarse particles, and the lowest fixing temperature was increased by 20° C.

The obtained results are shown in the following Table 1.

COMPARATIVE EXAMPLE 2

17 parts by weight of the primary particles A and 34 parts by weight of ion exchanged water were mixed, and the resulting liquid mixture was stirred with a homogenizer while gradually adding 45 parts by weight of a 5% aqueous solution of sodium chloride thereto. Thereafter, the liquid mixture was heated to 70° C. while stirring with a paddle blade, whereby agglomerated particles having a volume average diameter of 5.1 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 5.1 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.1 μm, the 50% number average diameter Dp was 4.5 μm, and Dp/Dv was 0.88.

The electrophotographic toner was placed in a multifunction machine e-STUDIO 281c manufactured by Toshiba Tec Corporation modified for evaluation, and the image quality and fixability were evaluated. As a result, although there was not any problem with the fixability, toner scattering at a thin line part of an image and toner fogging in a nonimage area were conspicuous.

The obtained results are shown in the following Table 1.

COMPARATIVE EXAMPLE 3

17 parts by weight of the primary particles A and 34 parts by weight of ion exchanged water were mixed, and the resulting liquid mixture was stirred with a homogenizer while gradually adding 45 parts by weight of a 0.1% aqueous solution of polyacrylamide (molecular weight: 2 million) thereto. Thereafter, the liquid mixture was heated to 35° C. while stirring with a paddle blade, whereby agglomerated particles having a volume average diameter of 8.5 μm were obtained. To the solution containing the agglomerated particles, 5 parts by weight of 10% sodium dodecylbenzene sulfonate was added to stabilize the agglomerated particles. Then, this solution was heated to 95° C., whereby fused particles having a volume average diameter of 8.3 μm, a 50% volume average diameter Dv of 8.5 μm, a 50% number average diameter Dp of 5.1 μm, a Dp/Dv value of 0.60 and a broad particle size distribution were obtained. Further, there were a lot of nonagglomerated particles, and toner formation could not be achieved.

The obtained results are shown in the following Table 1.

COMPARATIVE EXAMPLE 4

17 parts by weight of the primary particles A and 34 parts by weight of ion exchanged water were mixed, and the resulting liquid mixture was stirred with a homogenizer while gradually adding 45 parts by weight of a 0.1% aqueous solution of a polyalkylamino methacrylate quaternary salt (molecular weight: 3 million) thereto. Thereafter, the liquid mixture was heated to 35° C. while stirring with a paddle blade, whereby agglomerated particles having a volume average diameter of 10.5 μm were obtained. To the solution containing the agglomerated particles, 5 parts by weight of 10% sodium dodecylbenzene sulfonate was added to stabilize the agglomerated particles. Then, this solution was heated to 95° C., whereby fused particles having a volume average diameter of 8.3 μm, a 50% volume average diameter Dv of 10.5 μm, a 50% number average diameter Dp of 4.4 μm, a Dp/Dv value of 0.42 and a broad particle size distribution were obtained. Further, there were a lot of nonagglomerated particles, and toner formation could not be achieved.

The obtained results are shown in the following Table 1.

COMPARATIVE EXAMPLE 5

17 parts by weight of the primary particles A and 34 parts by weight of ion exchanged water were mixed, and the resulting liquid mixture was stirred with a homogenizer while gradually adding 45 parts by weight of a mixed aqueous solution containing 0.1% polyacrylamide (molecular weight: 2 million) and 1% sodium chloride thereto. Thereafter, the liquid mixture was heated to 50° C. while stirring with a paddle blade, whereby agglomerated particles having a volume average diameter of 7.5 μm were obtained. To the solution containing the agglomerated particles, 5 parts by weight of 10% sodium dodecylbenzene sulfonate was added to stabilize the agglomerated particles. Then, this solution was heated to 95° C., whereby a solution containing fused particles having a volume average diameter of 7.5 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 7.5 μm, the 50% number average diameter Dp was 5.5 μm, and Dp/Dv was 0.73.

The electrophotographic toner was placed in a multifunction machine e-STUDIO 281c manufactured by Toshiba Tec Corporation modified for evaluation, and the image quality and fixability were evaluated. As a result, the image was deteriorated due to coarse particles, and further, toner fogging in a nonimage area was generated and also the fixability was deteriorated.

The obtained results are shown in the following Table 1.

COMPARATIVE EXAMPLE 6

17 parts by weight of the primary particles A and 34 parts by weight of ion exchanged water were mixed, and the resulting liquid mixture was stirred with a homogenizer while gradually adding 45 parts by weight of a 5.0% aqueous solution of alkyl benzyl dimethyl ammonium chloride (approximate molecular weight: 340) thereto. Thereafter, the liquid mixture was heated to 50° C. while stirring with a paddle blade, whereby agglomerated particles having a volume average diameter of 5.8 μm were obtained. To the solution containing the agglomerated particles, 5 parts by weight of 10% sodium dodecylbenzene sulfonate was added to stabilize the agglomerated particles. Then, this solution was heated to 95°

C., whereby a solution containing fused particles having a volume average diameter of 5.8 μm was obtained.

Washing of the solid in the obtained solution was performed by repeating filtration and washing with ion exchanged water until the electrical conductivity of the filtrate became 50 μS/cm. Thereafter, the resulting solid was dried with a vacuum dryer until the water content became 0.3% by weight, whereby toner particles were obtained.

After drying, as additives, 2 parts by weight of hydrophobic silica and 0.5 part by weight of titanium oxide were adhered to the surface of the toner particles, whereby an electrophotographic toner was obtained.

The volume average particle diameter of the obtained electrophotographic toner was measured using a coulter counter manufactured by Beckman Coulter, Inc. As a result, the 50% volume average diameter Dv was 5.8 μm, the 50% number average diameter Dp was 4.7 μm, and Dp/Dv was 0.81.

The electrophotographic toner was placed in a multifunction machine e-STUDIO 281c manufactured by Toshiba Tec Corporation modified for evaluation, and the image quality and fixability were evaluated. As a result, although there was not any problem with the fixability, toner fogging in a nonimage area was generated.

The obtained results are shown in the following Table 1.

TABLE 1

| | Primary particle | Coagulating agent | Molecular weight | Metal salt | Dv (μm) | Dp (μm) | Dp/Dv | Image quality | Fixabillty |
|---|---|---|---|---|---|---|---|---|---|
| Example 1 | A | Polydiallyl dimethyl ammonium chloride | 9000 | Non | 5.5 | 4.7 | 0.85 | Good | Good |
| Example 2 | B | Polydiallyl dimethyl ammonium chloride | 9000 | Non | 4.5 | 3.8 | 0.84 | Good | Good |
| Example 3 | A | Polydiallyl dimethyl ammonium chloride | 9000 | Sodium chloride | 5.6 | 5.0 | 0.89 | Good | Good |
| Example 4 | A | Polydiallyl dimethyl ammonium chloride | 30000 | Sodium chloride | 5.4 | 4.7 | 0.87 | Good | Good |
| Example 5 | A | Polydiallyl dimethyl ammonium chloride | 4000 | Sodium chloride | 5.0 | 4.5 | 0.90 | Good | Good |
| Example 6 | A | Polyhydroxy propyldimethyl ammonium chloride | 10000 | Sodium chloride | 5.5 | 4.8 | 0.87 | Good | Good |
| Example 7 | PE resin + releasing agent + colorant | Polydiallyl dimethyl ammonium chloride | 9000 | Sodium chloride | 5.2 | 4.6 | 0.88 | Good | Good |
| Example 8 | St-Ac resin + releasing agent + colorant | Polydiallyl dimethyl ammonium chloride | 9000 | Sodium chloride | 5.0 | 4.4 | 0.88 | Good | Deteriorated and the lowest fixing temperature was increased by 10° C. |
| Comparative example 1 | A | Non | — | Aluminum sulfate | 6.0 | 4.8 | 0.80 | Deteriorated due to coarse particles | Deteriorated and the lowest fixing temperature was increased by 20° C. |
| Comparative example 2 | A | Non | — | Sodium chloride | 5.1 | 4.5 | 0.88 | Toner scattering at a thin line part was caused and toner fogging in a nonimage area was generated. | Good |
| Comparative example 3 | A | Polyacrylamide | 2 million | Non | 8.5 | 5.1 | 0.60 | Not evaluable | Not evaluable |
| Comparative example 4 | A | polyalkylamino methacrylate quaternary salt | 3 million | Non | 10.5 | 4.4 | 0.42 | Not evaluable | Not evaluable |
| Comparative example 5 | A | Polyacrylamide | 2 million | Sodium chloride | 7.5 | 5.5 | 0.73 | The image was deteriorated due to coarse particles and toner fogging in a nonimage area was generated. | Deteriorated and the lowest fixing temperature was increased by 10° C. |
| Comparative example 6 | A | Alkyl benzyl dimethyl ammonium chloride | 340 | Non | 5.8 | 4.7 | 0.81 | Toner fogging in a nonimage area was generated. | Good |

According to the invention, compared with an agglomeration method using a metal salt, deterioration of the chargeability and heat characteristic of a toner can be suppressed to the minimum. Further, compared with the case in which an agglomerating agent other than a metal salt is used, deterioration of particle size distribution can be improved, and uniform toner particles can be prepared. As described above, an image which achieves high image quality and energy saving can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A production method of a developing agent comprising:

melt kneading and pulverizing a mixture containing at least a polyester resin and a coloring agent to form a particulate mixture;

dispersing the particulate mixture in an aqueous medium to form a liquid dispersion of the particulate mixture, and subjecting the liquid dispersion to mechanical shearing to pulverize the particulate mixture to form fine particles, adding a cationic organic coagulating agent having an average molecular weight of from 1000 to 100000 to a liquid dispersion of the fine particles; and forming agglomerated particles by agglomerating fine particles in the aqueous medium.

2. The method according to claim 1, wherein the cationic organic coagulating agent is a quaternary ammonium salt.

3. The method according to claim 1, further comprising adding a pH adjusting agent when the cationic organic coagulating agent is added.

4. The method according to claim 1, further comprising adding a monovalent metal salt when the cationic organic coagulating agent is added.

5. A developing agent containing agglomerated particles which are obtained by melt kneading and pulverizing a mixture containing at least a polyester binder resin and a coloring agent to form a particulate mixture, adding a cationic organic coagulating agent having an average molecular weight of from 1000 to 100000 to a liquid dispersion of the fine particles, and forming agglomerated particles by agglomerating fine particles in the aqueous medium.

6. The developing agent according to claim 5, wherein the cationic organic coagulating agent is a quaternary ammonium salt.

7. The developing agent according to claim 5, further comprising a monovalent metal salt.

* * * * *